US007124838B2

(12) United States Patent
Stewart et al.

(10) Patent No.: US 7,124,838 B2
(45) Date of Patent: Oct. 24, 2006

(54) GRIPPING ASSEMBLY FOR IMPACT HAMMER

(75) Inventors: Billy M. Stewart, Spokane, WA (US); Dean F. Eisenbacher, Salem, OR (US); Matthew L. Kopp, Spokane, WA (US); Thomas J. Zysk, Spokane, WA (US); Catherine H. Sander, Spokane, WA (US)

(73) Assignee: The United States of America as represented by the Department of Health and Human Services, Washington, DC (US)

( * ) Notice: Subject to any disclaimer, the term of this patent is extended or adjusted under 35 U.S.C. 154(b) by 0 days.

(21) Appl. No.: 10/474,933

(22) PCT Filed: Apr. 5, 2002

(86) PCT No.: PCT/US02/10819

§ 371 (c)(1),
(2), (4) Date: Apr. 15, 2004

(87) PCT Pub. No.: WO02/090058

PCT Pub. Date: Nov. 14, 2002

(65) Prior Publication Data

US 2004/0168814 A1 Sep. 2, 2004

Related U.S. Application Data

(60) Provisional application No. 60/284,388, filed on Apr. 16, 2001.

(51) Int. Cl.
*E21B 31/18* (2006.01)
*E21B 41/00* (2006.01)

(52) U.S. Cl. ..... 173/25; 173/90; 173/185

(58) Field of Classification Search ..... 173/25, 173/90, 162.1, 185, 211; 414/739
See application file for complete search history.

(56) References Cited

U.S. PATENT DOCUMENTS

| | | | | |
|---|---|---|---|---|
| 2,078,848 A | | 4/1937 | Greger | |
| 4,466,494 A | | 8/1984 | Hanson | |
| 4,602,821 A | | 7/1986 | Schaeff | |
| 4,719,975 A | * | 1/1988 | LaBounty | 173/46 |
| 4,727,647 A | * | 3/1988 | Matson et al. | 29/838 |
| 5,588,794 A | | 12/1996 | Panyard | |
| 5,626,457 A | | 5/1997 | Hickman, Jr. | |

FOREIGN PATENT DOCUMENTS

SU 1406315 A1 6/1988

OTHER PUBLICATIONS

Patton et al., "Reducing Materials Handling Injuries in Underground Mines," *32nd Annual Institute on Mining Health, Safety, and Research,* pp. 123-135, Aug. 5-7, 2001, Salt Lake City, Utah.
Stewart et al., "Methods to Minimize Injuries in Materials-Handling Processes in Underground Mines," *2002 SME Annual Meeting,* pp. 1-8, Feb. 25-27, Phoenix, Arizona.
Stewart et al., "Materials handling accident reduction in underground mines," *6th International Symposium on Mine Mechanization and Automation,* pp. 159-166, South African Institute of Mining and Metallurgy, 2001.

* cited by examiner

*Primary Examiner*—Rinaldi I. Rada
*Assistant Examiner*—Nathaniel Chukwurah
(74) *Attorney, Agent, or Firm*—Klarquist Sparkman, LLP

(57) ABSTRACT

A gripping assembly mounted on an impact hammer having a longitudinally extending impact axis, the gripping assembly including a pair of opposed elongate gripping arms, having gripping end portions which may be extended and swung toward each other to grip material in the region of the working end of the impact hammer. When retracted, the gripping arms rest to opposite sides of the impact hammer to permit free operation of the impact hammer.

11 Claims, 4 Drawing Sheets

GRIPPING ASSEMBLY FOR IMPACT HAMMER

CROSS-REFERENCE TO RELATED APPLICATION

This is a national stage under 35 U.S.C. §371 of International Application No. PCT/US02/10819, filed Apr. 5, 2002, and claims the benefit of U.S. Provisional Patent Application No. 60/284,388, filed Apr. 16, 2001.

FIELD OF THE INVENTION

This invention relates generally to material working equipment, more particularly to equipment in which a gripping assembly is adapted to be associated with an impact hammer to permit materials in the region of the impact hammer to be grasped and manipulated.

BACKGROUND

In mining, excavation, and other fields, it often is necessary to provide means for breaking and maneuvering, or manipulating, hardened materials, such as rock.

One example of an area in which such need exists is in mining applications in which excavated rock is dumped onto a large screening device known as a grizzly. Grizzlies often are recessed below working level to accommodate sidecar or truck dumping of material thereon. The grizzly may become clogged by dumping oversized rock or boulders thereon, by finer material bridging the openings in the grizzly, and by other types of debris that may have been mixed with the mined materials.

In the past, many mine operators have resorted to manual labor to clear material from the grizzlies. For example, workmen move into the grizzly region with sledgehammers, rope slings, etc. to break up oversized rock and to attempt to remove debris therefrom.

In other operations, permanently installed impact hammers are used to break the oversized rock, such that it may move through the pre-selected sized openings in the grizzly. However, they provide no means for grasping and manipulating stone or debris, other than to attempt to break it by use of the impact hammer.

In light of the number of accidents that have occurred in the use of manual labor to clear grizzlies, and the ineffectiveness of jackhammers alone, it has become important to provide some means for breaking hardened materials, such as rocks, and to manipulate or grasp materials in the region of the impact hammer.

SUMMARY OF THE DISCLOSURE

In one aspect of the present disclosure, a gripping arm assembly is adapted to be mounted on an impact hammer having a longitudinally extending impact axis. The assembly includes a pair of opposed, laterally spaced, elongate gripping arms, each of which has a gripping portion adjacent one of its ends, mounting mechanism adapted to mount the arms on the impact hammer for movement between retracted, non-gripping positions, and extended gripping, or pinching, positions, and operator mechanism coupled to the gripping arms operable to shift them between their retracted and extended positions.

Another aspect of the disclosure is to provide a mounting mechanism which includes a track for each gripping arm for guiding movement of the gripping portion of the gripping arm as it is shifted between its retracted and extended positions.

Yet another aspect of the disclosure is to provide a gripping arm assembly adapted to be mounted on an impact hammer, in which a gripping arm includes a connector portion connected to operator mechanism and a swinging portion pivotally coupled to the connector portion to permit swinging of the swinging portion between non-gripping and gripping positions as it shifted from its retracted to its extended positions.

A still further aspect of the disclosure is the provision of such an assembly in which a gripping arm has substantial width at its gripping end to provide firm gripping of objects, and also to permit sweeping action with the gripping arm.

Yet another aspect of the disclosure is to provide a tool assembly adapted to break hardened materials and to manipulate materials whereby such joint operations can be achieved without placing workmen in unduly hazardous conditions.

These and other aspects of the disclosure will become more clearly apparent as the following description is read in conjunction with the drawings.

DESCRIPTION OF PREFERRED EMBODIMENT

Figure 1:
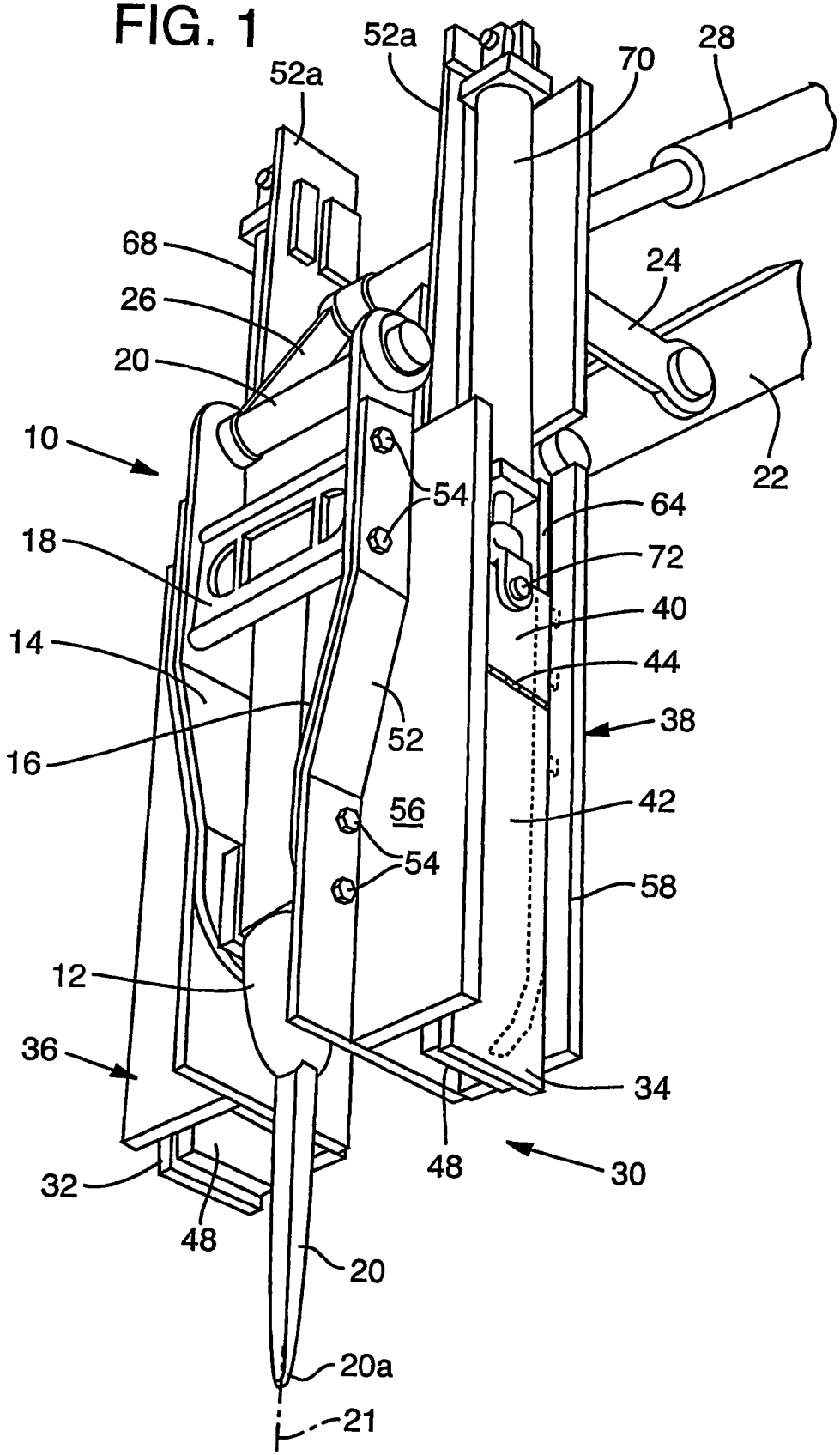
FIG. 1 is a bottom front perspective view of an impact hammer having a gripping arm assembly attached thereto, with the gripping arms in retracted, non-gripping positions.
Figure 2:
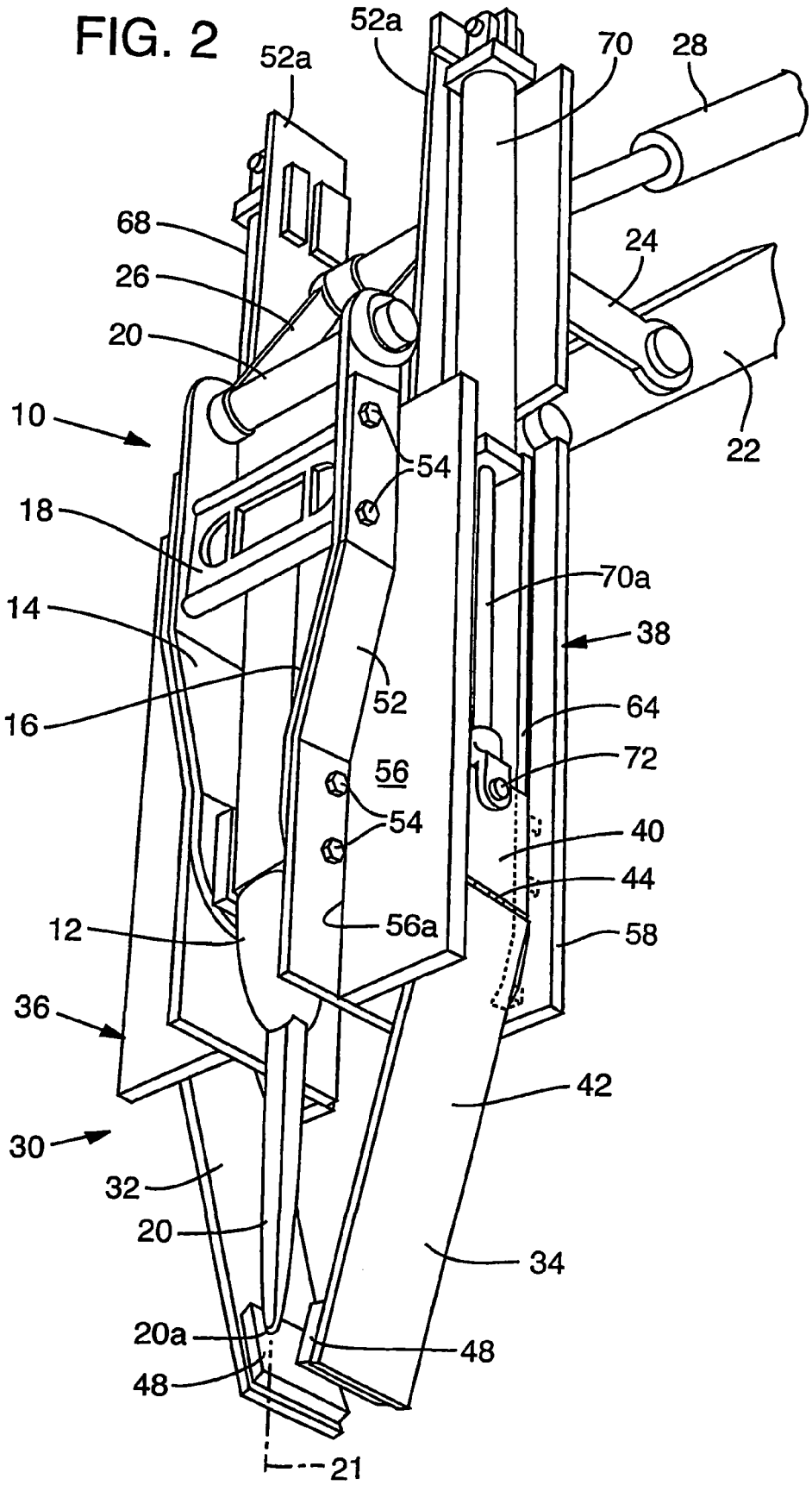
FIG. 2 is a view similar to FIG. 1, with the gripping arms in extended, gripping positions.

Referring to FIGS. 1 and 2, at 10 is indicated generally apparatus according to an embodiment of the disclosure. A fluid-pressure-actuated impact hammer 12 is secured to and supported between a pair of opposed, laterally spaced support plates 14, 16. The upper ends of support plates 14, 16 are interconnected by a cross-member 18 and a shaft 20. Impact hammer 12 has an elongate impact member 20 with a lower, or distal, working end 20*a*. The impact hammer has a longitudinally extending impact axis 21, which extends through impact member 20. As is known, the impact hammer is operable to rapidly reciprocate member 20 under power to break, or separate, hardened material.

The outer, or distal, end of an elongate, maneuverable boom 22 is connected through various connecting members, such as links 24, 26 and other parts unseen in the figures to support plates 14, 16 permitting articulation of the impact hammer at the outer end of boom 22. An elongate extensible-retractable ram 28 is operatively connected to the support assembly for impact hammer 12, such that extension and retraction of the ram pivots the impact hammer relative to boom 22.

Boom 22 may be mounted on either stationary or mobile equipment. For example, a stationary base may be mounted adjacent an area in which the impact hammer and mechanism is desired to be used, or it may be mounted on the boom of a vehicle allowing it to be moved to and used in a variety of locations.

Gripping assembly mechanism, indicated generally at 30, is secured to and moveable with impact hammer 12. Gripping assembly 30 includes a pair of opposed, laterally spaced apart, elongate gripping arms 32, 34. The gripping arms are attached to the impact hammer through mounting mechanism indicated generally at 36, 38.

Gripper arms 32, 34, and mounting mechanism 36, 38 are substantially mirror images of each other mounted on opposite sides of impact hammer 12. Thus, only one set of such will be described in detail, recognizing that the other set is generally the same, but mounted in mirror-image fashion relative to the one described.

Figure 3:
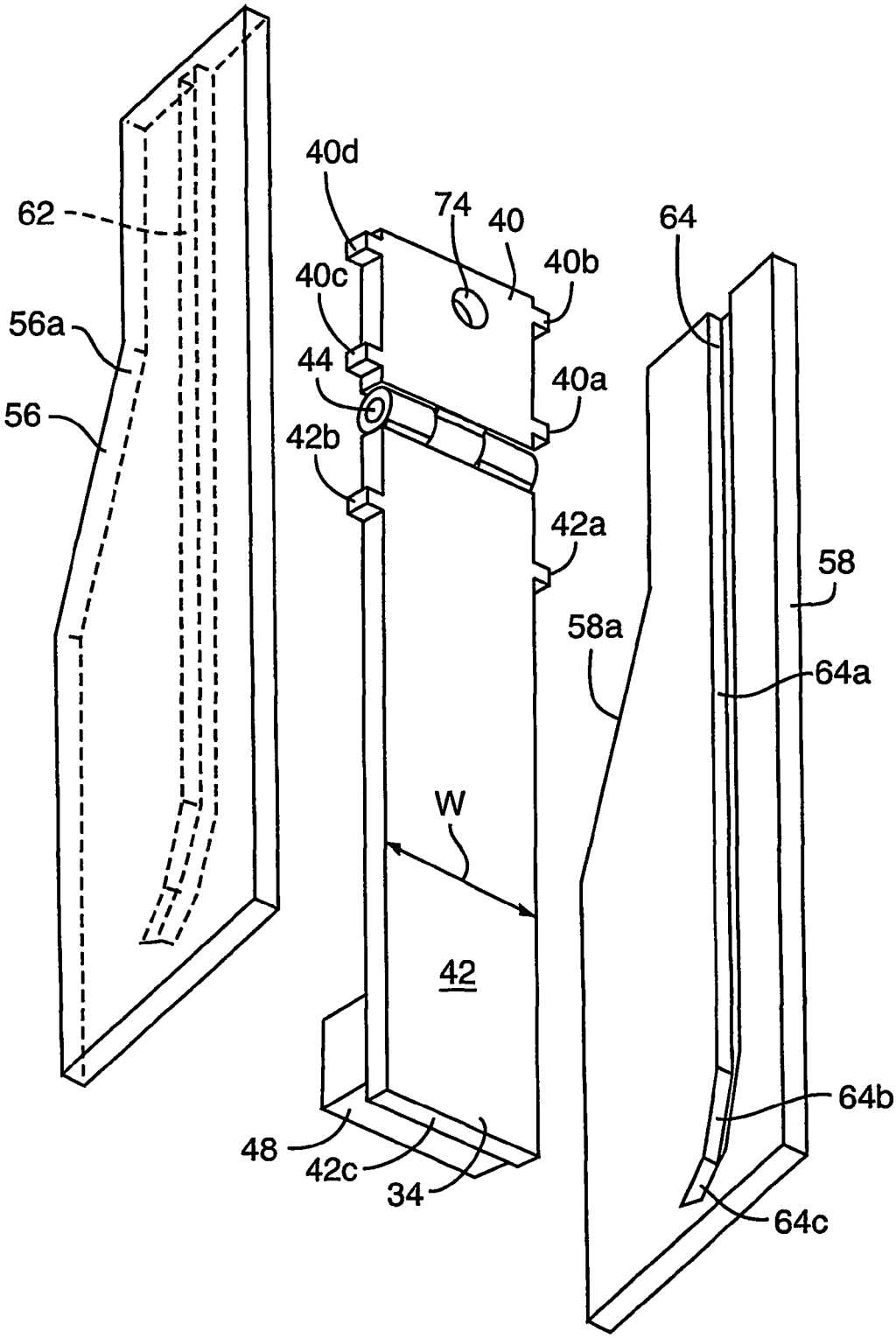
FIG. 3 is an enlarged, exploded perspective view of a gripping arm removed from the assembly with associated mounting plates.

Referring to FIG. 3, gripping arm 34 includes an upper, or first, plate portion 40 and a lower, or second, plate portion 42. A hinge 44 pivotally interconnects plate portions 40, 42.

Plate portion 40 has a first pair of spaced apart projections 40*a*, 40*b*, also referred to as connector guides, extending outwardly from one of its side edges, and another pair of spaced apart projections 40*c*, 40*d* extending outwardly from its opposite side edge. Similar projections 42*a*, 42*b*, also referred to as swing guides, extend outwardly from opposite side edges of plate portion 42 in a region spaced from hinge 44. As seen in FIG. 3, projections 42*a*, 42*b* are substantially aligned with each other on opposite sides of plate portion 42. The distal, or lower, end portion 42*c* of plate portion 42 is referred to herein as a gripping portion. A gripping pad 48 is secured to the gripping portion of plate 42. The gripping pad 48 may be removably secured to plate 42, as by screws or bolts, permitting replacement as needed.

Figure 4:
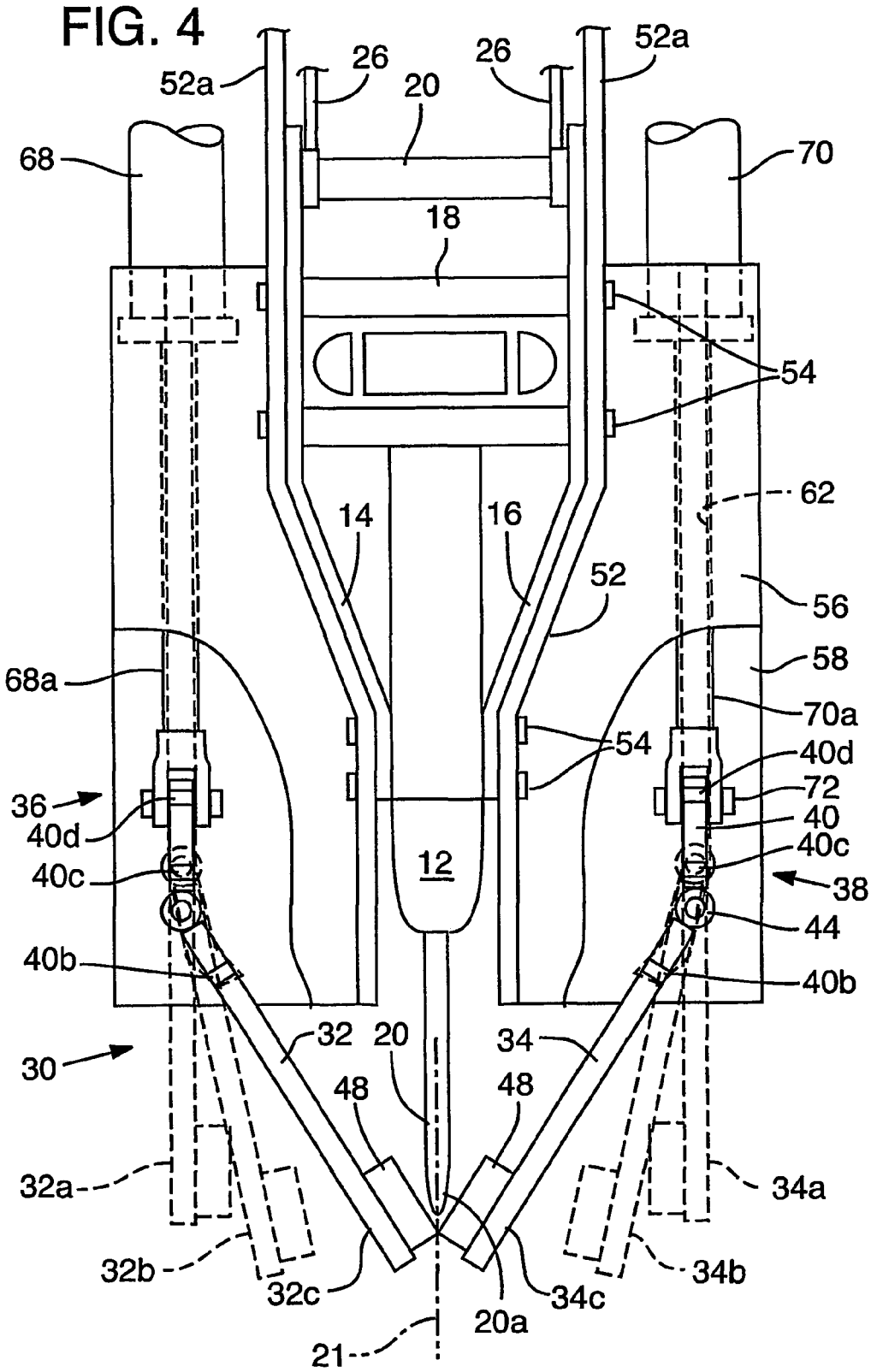
FIG. 4 is a front elevational view of the device illustrated in FIGS. 1 and 2, with the arms shown in various operating positions.

Referring to FIGS. 1, 2 and 4, the mounting mechanism 38 includes a backing plate 52. Backing plate 52 is bent into a configuration to conform to the bend lines of its associated support plate 16 of the impact hammer and has an upstanding upper portion 52*a*. The backing plate is secured to its associated support plate (14 or 16) as by bolts or screws 54.

A pair of guide plates 56, 58 have one set of edges 56*a*, 58*a* (see FIG. 3) configured to conform to the bends of plate 52 and are secured to plate 52, as by welding, along their formed edges 56*a*, 58*a* in substantially parallel, spaced-apart orientation as illustrated in FIGS. 1 and 2. The lateral spacing between the inner side surfaces of plates 56, 58 is slightly greater than the side-to-side width dimension noted W in FIG. 3 of gripping arm 34. Preferably width W may be in a range of 5 to 20 inches.

Guide plates 56, 58 have guide tracks, or grooves, 62, 64 extending along their inwardly facing surfaces. Grooves 62, 64 are substantially parallel to each other, and thus only groove 64 will be described in detail, understanding that groove 62 would be similar. Groove 64 has an elongate first portion 64*a* extending substantially longitudinally of plate 58, a second portion 64*b*, which on extending downwardly is angled inwardly toward impact axis 21 at a small angle, and a third, or lower, portion 64*c* which is angled inwardly toward edge 56*a* and impact axis 21 at a greater angle than second portion 64*b*.

Projections 40*a*, 40*b*, 42*a* rest slidably in groove 64, and projections 40*c*, 40*d*, 42*b* rest slidably in groove 62.

Operator mechanism, in the form of a pair of elongate, fluid-actuated, extensible-retractable rams 68, 70 are operatively coupled to gripping arms 32, 34. The upper end of each of rams 68, 70 is secured to its associated upstanding portion 52*a* of a backing plate 52. The rod ends 68*a*, 70*a* of rams 68, 70 are connected to the first portions 40 of their associated gripping arms through pins 72 extending through holes 74 in the upper portions of the gripping arms. The rams may be supplied pressurized fluid from the same source which supplies impact hammer 12, or a separate source may be provided.

When rams 68, 70 are in their retracted positions, as illustrated in FIG. 1, portions 40, 42 of the gripping arms are substantially aligned in vertically disposed positions and are spaced upwardly and away from opposite sides of the operating tip 20*a* of impact member 20.

When rams 68, 70 are extended, gripping arms 32, 34 are shifted downwardly between their associated side guide plates. So long as the projections, such as those indicated at 42*a*, 42*b* on gripping arm portion 42 remain in the vertically disposed portions of the guide channels, such as that indicated at 64*a*, gripping arm portion 42 does not begin to swing toward impact member 20. This somewhat extended, but still vertical, position for arms 32, 34 is indicated generally at 32*a*, 34*a* in dashed outline in FIG. 4.

As rams 68, 70 continue to extend, projections such as those indicated at 42*a*, 42*b* move into the slightly inwardly angled second portions of the groove, such as that indicated at 64*b*, and the lower portions of the gripping arms begin to swing inwardly toward the impact axis 21 as indicated at 32*b*, 34*b* in FIG. 4.

As rams 68, 70 continue to extend and shift the gripping arms to their substantially fully extended positions, as indicated at 32*c*, 34*c* in FIG. 4, the gripping pads 48 on the opposed arms are swung together on opposite sides of the impact axis 21 in a region spaced longitudinally outwardly from the tip 20*a* of impact member 20. The spacing between projections on the upper, or first, portion 40 of a gripping arm is sufficiently above projections on the lower plate portion, such as those indicated at 42*a*, 42*b*, that the upper plate portion will remain substantially vertical in the upright groove portions such as that indicated at 64*a*, while the lower plate portions swing toward the impact axis 21.

The arms being swung toward each other under the power of rams 68, 70 allows the arms to grip material in the region of the impact hammer and manipulate it as desired.

Explaining operation of the apparatus thus described, with the gripping arms 32, 34 in their retracted position as illustrated in FIG. 1, impact member 20 of impact hammer 12 may be used in its normal fashion to break hardened material, such as rock, concrete, etc. By being mounted at the outer end of a moveable boom 22 and being manipulatable by action of ram 28 and other movement of boom 22, the impact hammer may be directed as desired.

Should it be desired to grip and move material in the region of the working end 20*a* of impact member 20, gripping arms 32, 34 may be extended by extension of rams 68, 70 to the gripping position illustrated in FIG. 2 and in solid outline in FIG. 4. The travel pattern for the second, or lower, portions of arms 32, 34 is indicated in FIG. 4, with the initial extension being as shown at 32*a*, 34*a*. As the arms are extended further and the projections thereon move slidably into angled portions of the tracks, such as that illustrated at 64*b* in FIG. 3, the arms swing in a slight amount as indicated in 32*b*, 34*b*. Extension to the full lower limit, as illustrated in FIG. 2 and solid outline in FIG. 4, causes the lower ends of arms 32, 34 to swing together to grip material therebetween. Gripping pads 48 assist in gripping.

With material gripped between arms 32, 34, the boom 22 and the mount for impact hammer 20 may be manipulated to lift and move gripped material. Upon movement to a selected position, it is a simple matter to retract rams 68, 70 to swing the gripping arms open, thus releasing the grip on such material and releasing it from the arms.

Such equipment should work well in mining operations where it may be necessary to clear material from screens, such as grizzlies. In such operation, the boom may maneuver impact member 20 to break up large boulders or other materials on the screen, or grizzly, such that it may be sized to fall through the screen. Should debris which should not go through the grizzly be noted in the material, such debris may be grasped by arms 32, 34 and removed from the grizzly.

Further, with the arms in their extended positions, as illustrated in FIG. 2, it will be seen that they have substantial width and may be used in a side-to-side sweeping action upon movement of boom 22 in a side-to-side fashion to move material about in the mass of material on the grizzly. Also, with the arms retracted the mounting plates (56, 58) have sufficient width that they may be used in a fore-to-aft sweeping action.

While a preferred embodiment has been described herein, it should be apparent to those skilled in the art that variations and modifications are possible without departing from the spirit of the invention.

We claim:

1. A gripping assembly adapted to be mounted on an impact hammer having a longitudinally extending impact axis, the assembly comprising:

a pair of opposed, laterally spaced apart, elongate gripping arms, each of which has a gripping portion adjacent one of its ends, mounting mechanism adapted to mount said arms on said impact hammer with said gripping arms spaced to opposite sides of said impact axis and shiftable longitudinally between retracted and extended position, with said gripping portions of said arms spaced apart a selected distance when said arms are retracted and said gripping portions moving toward each other as said gripping arms are shifted toward their extended positions, wherein said mounting mechanism comprises a track to which a gripping arm is coupled, with said track guiding movement of said gripping portion as said gripping arm is shifted between its retracted and extended positions, and operator mechanism coupled to said gripping arms operable to shift said arms between their retracted and extended positions.

2. The assembly of claim 1, wherein said mounting mechanism comprises a plate element having an elongate groove formed therein defining said track and said gripping arm has a projection thereon slidably received for movement in said groove.

3. The assembly of claim 1, wherein a gripping arm comprises a connector portion connected to said operator mechanism and a swinging portion pivotally coupled to said connector portion to permit swinging of said swinging portion relative to said connector portion toward and away from said impact axis.

4. The assembly of claim 1, wherein said operator mechanism comprises an elongate fluid-actuated ram.

5. The assembly of claim 1, wherein a gripping pad is mounted on a distal gripping end portion of said gripping arm.

6. The assembly of claim 1, wherein the impact hammer has an elongate impact member disposed on said impact axis and a gripping arm comprises an elongate plate element which when in its extended position is disposed adjacent said impact member.

7. The assembly of claim 6, wherein said gripping arm has substantial width at its gripping end to permit sweeping action.

8. The assembly of claim 1, further comprising said impact hammer, wherein said impact hammer has a material impacting member disposed on said longitudinally extending impact axis.

9. The assembly of claim 8, wherein said material impacting member has a distal material engaging end and said gripping portions of said arms, when said arms are shifted to their extended positions, are configured to close on said impact axis in a region spaced longitudinally outwardly from said distal end of said material impacting member.

10. A gripping assembly adapted to be mounted on an impact hammer having a longitudinally extending impact axis, the assembly comprising:

a pair of opposed, laterally spaced apart, elongate gripping arms, each of which has a gripping portion adjacent one of its ends, mounting mechanism adapted to mount said arms on said impact hammer with said gripping arms spaced to opposite sides of said impact axis and shiftable longitudinally between retracted and extended position, with said gripping portions of said arms spaced apart a selected distance when said arms are retracted and said gripping portions moving toward each other as said gripping arms are shifted toward their extended positions, and operator mechanism coupled to said gripping arms operable to shift said arms between their retracted and extended positions, wherein a gripping arm comprises a connector portion connected to said operator mechanism and a swinging portion pivotally coupled to said connector portion to permit swinging of said swinging portion relative to said connector portion toward and away from said impact axis, and said mounting mechanism comprises an elongate track, a connector guide on said connector portion engaging and guided by said track, and a swing guide on said swinging portion engaging and guided by said track, with a first guide portion of said track extending substantially parallel to said impact axis and a second guide portion of said track angled toward said impact axis, the positions of said first and second guide portions being such that said connector portion and said swinging portion remain spaced from said impact axis throughout a major portion of their travel from their retracted toward their extended positions, and upon nearing the extended position said swinging portion swings toward said impact axis.

11. The assembly of claim 10, wherein said gripping portion is on a distal end portion of said swinging portion.

* * * * *